United States Patent [19]

Dixon

[11] 4,255,822

[45] Mar. 17, 1981

[54] SHOE HOLDER ADAPTERS FOR STIFF PLATFORM

[76] Inventor: William Dixon, Rte. #2, Box 2009, Browns Mills, N.J. 08015

[21] Appl. No.: 956,128

[22] Filed: Oct. 30, 1978

[51] Int. Cl.[3] ..... A61F 3/00; A63B 25/06

[52] U.S. Cl. ..... 3/4; 272/70.2

[58] Field of Search ..... 272/70, 70.1, 70.2, 272/94, 96, 97; 280/11.3, 11.31, 11.32, 11.33, 11.34, 611, 614, 617, 623, 624; 128/25 B; 3/4, 5; 36/7.5; 81, 132, 136; 182/230

[56] References Cited

U.S. PATENT DOCUMENTS

| | | | |
|---|---|---|---|
| 25,035 | 8/1859 | Norton | 280/11.3 |
| 25,665 | 10/1859 | McCluskey, Jr. | 280/11.33 |
| 84,267 | 11/1868 | Davis | 36/7.5 |
| 642,841 | 2/1900 | Freshour . | |
| 1,179,496 | 4/1916 | Bartholomew . | |
| 1,422,683 | 7/1922 | Eltgroth | 36/7.5 X |
| 1,613,535 | 1/1927 | Root . | |
| 1,843,493 | 2/1932 | Pfeifenbring | 3/5 X |
| 1,905,112 | 4/1933 | Lang . | |
| 1,975,299 | 10/1934 | Tappe | 280/11.31 |
| 2,201,990 | 5/1940 | Dekome et al. | |
| 2,659,087 | 11/1953 | Skaggs et al. | |
| 2,736,902 | 3/1956 | Bass . | |
| 2,837,335 | 6/1958 | Koenig . | |
| 3,058,120 | 10/1962 | Smith et al. | |
| 3,102,272 | 9/1963 | Emmert . | |
| 3,279,808 | 10/1966 | Brownlee et al. | |
| 3,377,722 | 4/1968 | Downing | 272/70.1 UX |
| 3,626,519 | 12/1971 | Baker . | |

FOREIGN PATENT DOCUMENTS

| | | | |
|---|---|---|---|
| 13974 | 11/1899 | Sweden | 280/11.30 |
| 117557 | 11/1926 | Switzerland | 36/7.5 |
| 178585 | 7/1935 | Switzerland | 280/11.31 |
| 399272 | 3/1966 | Switzerland | 3/4 |
| 1344 | of 1891 | United Kingdom | 280/11.31 |
| 3982 | of 1904 | United Kingdom | 3/4 |
| 195228 | 3/1923 | United Kingdom | 272/70.1 |

OTHER PUBLICATIONS

Bill's Drywall Tool Co., Inc., P.O. Box 411, Pemberton, N.J. 08068.

Ames Quality Tools Catalog 1977, p. 7.

Ames Quality Tools Catalog 1978, p. 3.

*Primary Examiner*—Richard C. Pinkham

*Assistant Examiner*—Arnold W. Kramer

*Attorney, Agent, or Firm*—John J. Kane; Frederick A. Zoda; Albert Sperry

[57] ABSTRACT

A shoe adapter for use for holding the user's shoe in fixed engagement with the shoe receiving stilt platforms of utility stilts, the shoe adapter including a frontal member fixedly secured to the stilt platform adapted to receive the frontal area of the user's shoe and including a heel member fixedly secured to the stilt platform in spaced relation with respect to the frontal member such that when the heel of the shoe of the user is placed within the heel member, the frontal area of the user's shoe will be locatable within the frontal member, the frontal member including a frontal base directly attached to the platform and a rigid upper member extending from one lateral end of the frontal base to the other lateral end of the frontal base to define a frontal shoe area receiving opening between the rigid upper member and the frontal base, the heel member including a heel base fixedly secured to the stilt platform, and at least two lateral heel plates extending upwardly from the lateral edges of the heel base to define a heel receiving means, the two lateral heel plates being alternatively inclined slightly inwardly to facilitate the retaining of the heel of the user's shoe in the adapter.

7 Claims, 6 Drawing Figures

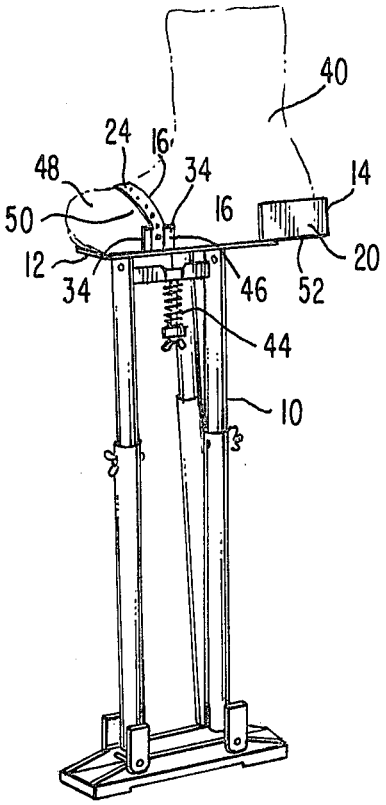
Fig. 1
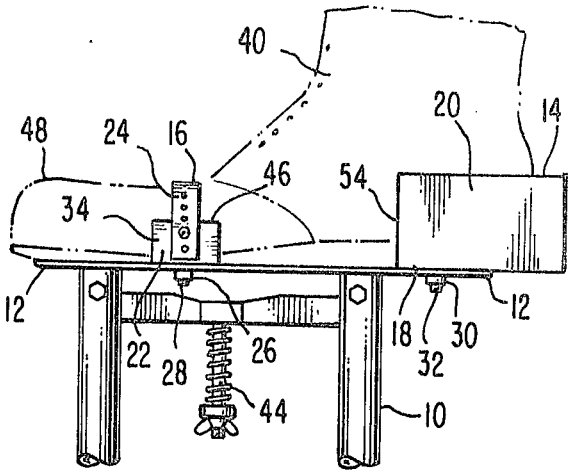
Fig. 2
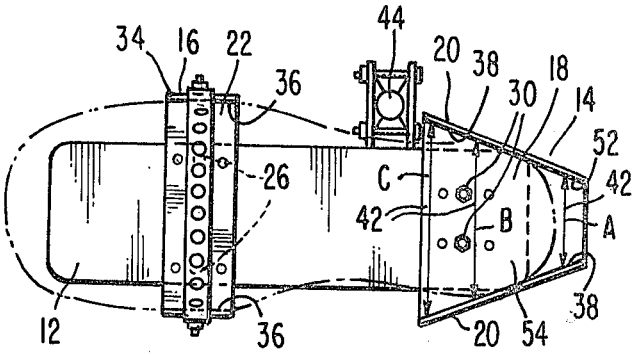
Fig. 3
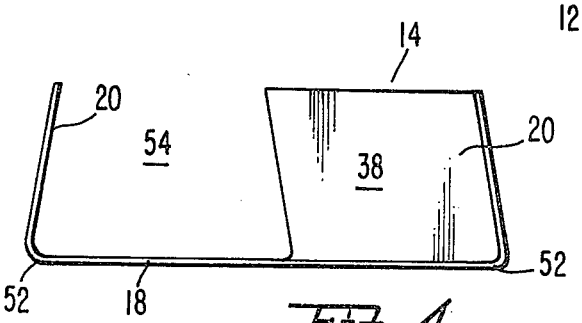
Fig. 4
Fig. 5
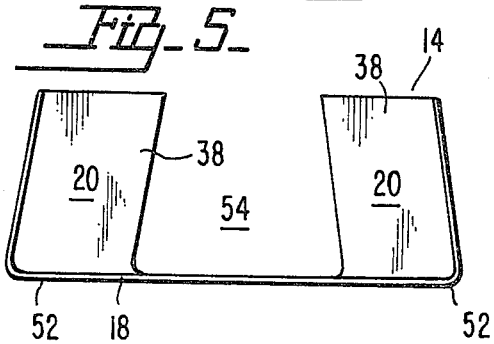
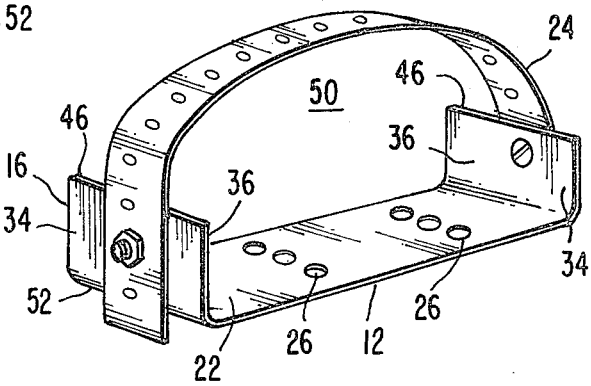
Fig. 6

SHOE HOLDER ADAPTERS FOR STIFF PLATFORM

BACKGROUND OF THE INVENTION

1. Field of the Invention

In the field of construction, workers often require usage of utilitarian walking stilts to provide elevated height to facilitate working in high areas such as ceilings and the like. Such stilts are particularly usable for painting and plastering operations where an extended amount of time must be spent at an elevated height. The present invention provides a novel adapter to assure fixed engagement between the shoes of the construction worker and the stilt itself.

Heretofore, it was often the practice for the worker to directly bolt the shoes themselves to the platform of the stilt adapted to be stood upon. In this matter the shoes would become permanent fixtures of the utility stilts and the resulting stilting assembly would be laced to the feet of the user for each usage. Another means of attachment widely utilized has been one of a variety of available strapping adapters. Basically the user's shoes would be placed upon the platform of the stilts and a plurality of belts, buckles or straps would be wrapped about the ankle or frontal foot area of the user to assure firm engagement between his leg and the stilt. These configurations have proven to be unduly expensive and time consuming and as such the present invention provides a novel and yet inexpensive replacement therefore.

2. Description of the Prior Art

Many configurations have been patented for securing engagement between stilt platforms or other similar platforms and shoes of a user. Examples of such patented designs are disclosed in U.S. Pat. Nos. 3,626,519; 3,279,808; 3,102,272; 3,058,120; 2,736,902; 2,659,087; 2,201,990; 1,179,496; 1,905,112; 1,179,496; 642,841; and 1,613,535.

One of the most pertinent of these patents is U.S. Pat. No. 3,626,519 issued to J. W. Baker on Dec. 14, 1971. This patent is a prime example of the belt and buckle arrangements which have been utilized heretofore in order to strap the ankle and forefoot of the wearer to the stilt platform. The present invention is distinguishable from this patent and all other prior art heretofore in that no such strap and buckle assemblies are required by the placement of a single rigid frontal strap and a self-adjustable heel retaining cup arrangement. With the applicant's configuration construction stilts can be slipped on and slipped off quite easily without requiring the wearer to perform any buckling or strapping operation.

SUMMARY OF THE INVENTION

The present invention provides an adapter for selectively and fixedly engaging the shoe receiving stilt platform of a utility stilt with the shoe of the user. This adapter allows such fixed engagement without the use of belts, straps or other similar buckling devices. The adapter includes a frontal member which is fixedly secured to the stilt platform and is adapted to receive and hold the frontal area of the user's shoe therein. The adapter also includes a heel member which is fixedly secured to the other end of the stilt platform and is adapted to receive and hold the heel area of the user's shoe therein when the frontal area of the user's shoe is placed within the frontal member.

The frontal member includes a frontal base which is fixedly secured to the stilt platform by a frontal attachment means such as a standard screw and nut assembly. The frontal member may further include a lateral front plate at each opposite lateral end of the frontal base which extends upwardly therefrom to facilitate retaining of the shoe of the user within the frontal shoe area by preventing lateral movement or sliding of the shoe when in this position. The frontal member also includes a rigid upper member which extends from one end of the frontal base to the other end thereof and disposed in spaced relation thereabove to define a frontal shoe receiving opening in to which the user will place the frontal area of the shoe. Alternately, the rigid upper member may extend from one lateral front plate to the other lateral front plate if such plates are included in the structure.

The heel member includes a heel base which is fixedly secured to the stilt platform at a location in spaced relation with respect to the frontal member to thereby allow placement of the heel area of the user's shoe onto the heel base when the frontal shoe area has been placed within the frontal shoe area receiving means. The heel member also includes a heel attachment means which is adapted to fixedly secure the heel base to the stilt platform which may take the form of a standard screw and nut configuration. The heel member also includes at least two lateral heel plates which extend upwardly from the lateral edges of the heel base. In this manner the inside surfaces of the lateral heel plates and the upper surface of the heel base define a heel receiving means for holding the heel in fixed engagement with the stilt platform simultaneously with the holding of the frontal area of the shoe fixedly in engagement with the frontal member and consequently with the stilt platform. Preferably the lateral heel plates positioned on opposite sides of the heel will be inclined slightly upwardly and inwardly with respect to the heel base and the person's shoe in order to facilitate retaining of the heel area of the shoe in engagement with the stilt platform.

It is an object of the present invention to provide a means for selective engagement between a stilt platform of utility stilts and the shoes of the user.

It is an object of the present invention to provide a means for fixedly securing stilts to the feet of workers wherein no straps, belts or buckles are utilized.

It is an object of the present invention to provide a slip-on arrangement for securing stilts to the shoes of the workers.

It is an object of the present invention to provide an inexpensive means for securing a beltless shoe engaging adapter positionable between utility stilts and the shoes of the worker.

It is an object of the present invention to provide a slip-on adapter for use with utility stilts which prevents the necessity for shoes being bolted directly to the stilts through holes provided in the foot plate of the stilts.

It is an object of the present invention to provide a beltless shoe adapter which automatically adjusts to varying shoe sizes by the obliquely angular longitudinal orientation between the lateral heel plates thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of an embodiment of the beltless shoe adapter of the present invention;

FIG. 2 is a side view of an embodiment of the present invention;

FIG. 3 is a top plan view of an embodiment of the present invention;

FIG. 4 is a front angular view of an embodiment of a heel member of the present invention;

FIG. 5 is a front view of an embodiment of a heel member as shown in FIG. 4; and FIG. 6 is a front perspective view of an embodiment of the frontal member of the present invention.

DETAILED DESCRIPTION OF THE PREFERRED EMBODIMENT

The present invention provides a beltless shoe adapter for use for holding the user's shoes 40 in firm engagement with the shoe receiving stilt platforms 12 of standardly configured utility stilts 10.

The shoe adapter achieves a beltless engagement between the shoe 40 and the stilt platform 12 by the inclusion of a heel member 14 and a frontal member 16. Frontal member 16 encludes a generally flatly extending frontal base 22 which is fixedly secured to the stilt platform by frontal attachment means 26 such as a frontal threaded means 28 comprising basically a screw and nut assembly. The frontal shoe area 48 is retained in fixed position upon the frontal base 22 by a rigid upper member 24 which is selectively fixedly secured to opposite lateral ends of the frontal base 22. In this manner the lower surface of the rigid upper member 24 and the upper surface of the frontal base 22 defines a frontal shoe area receiving opening 50 which is adapted to receive the frontal shoe area 48 therein and retain in fixed position when the heel area of the shoe is placed in the heel member 14. Frontal member 16 may alternatively include lateral frontal plates 34 which are adapted to prevent lateral sliding of the frontal shoe area 48. These lateral frontal plates generally extend upwardly from the lateral edges of the frontal base 22 and therefore are useful both in preventing this sliding motion and in providing an upwardly disposed tab to which the rigid upper member 24 may be easily secured. The lateral sliding movement of the frontal shoe area 48 is prevented by the inwardly disposed surfaces of the lateral front plates 34 which are defined as the frontal lateral retaining surfaces 36. In this manner these surfaces in combination with the rigid upper surface 24 provide more stability in engagement between the stilt platform 12 and the frontal shoe area 48 than would be provided merely by attachment of the rigid upper member 24 directly to the lateral ends 46 of the frontal base 22.

The beltless shoe adapter of the present invention also includes a heel member 14 which is fixedly secured to the stilt platform 12 and adapted to receive and hold the heel area of shoe 40 therein. The heel member 14 will include a heel base 18 which is fixedly secured to the stilt platform 12 at a location in spaced relation with respect to the frontal member 16 to allow the placement of the heel area of the user's shoe 40 upon the heel base 18 when the frontal shoe area has already been located within the frontal shoe area receiving means 50. Heel base 18 is secured to the stilt platform 12 by a heel attachment means 30 such as heel threaded member 32 which normally will comprise a standard screw and nut configuration. The heel member will further include at least two lateral heel plates 20 which extend upwardly from the lateral edges 52 of the heel base to define a heel receiving means 54. The heel receiving means or opening will therefore be defined by the upper surface of the heel base and the inwardly facing surfaces 38 of the lateral heel plates 20 to thereby co-operate with the frontal shoe area receiving opening 50 to hold the shoe of the user in firm engagement with the stilt platform 12 during usage thereof.

As best shown in FIG. 3 the dotted outline of shoe 40 is shown placed upon stilt platform 12. The stilt platform 12 is shown connected to the stilt support member 44 which is one of the means of support of the stilt platform 12 at the elevated orientation with respect to ground level. The outline of the shoe is shown positioned within the frontal shoe area receiving opening 50 and the heel area of the shoe is shown positioned within the heel receiving means 54. The lateral heel plates 20 are shown angularly oriented with respect to one another such that the ends thereof closest to the frontal member are spaced at a distance from one another greater than at the opposite end thereof. In other words the lateral heel plates are close together at the far rearward position and become gradually further apart at locations closer to the frontal shoe area. In this manner a self-adjusting configuration is achieved in order for the adapter to be able to receive variably sized shoes. In particular as shown by the arrows A, B, and C the lateral distance of the heel of the shoe may vary and still be usable with the same beltless shoe adapter. This self-adjusting is made possible due to the absence of a rear wall in the heel receiving means. Instead of a rear wall the two rearmost edges of the lateral heel plates will define an open rear area. In prior art configurations a rear wall is included which fixes the point of placement of a user's shoe longitudinally within such a shoe retaining device, however with the present invention the point of longitudinal placement is variable due to the open rear area defined by the rear edges of the lateral plates which thereby provides the feature of self-adjustment in the present design. In particular with smaller shoes a narrower lateral width such as shown by arrow A will be utilized whereas with an average shoe the width as shown by arrow B will be used furthermore with wide shoes the arrows defined as C will be utilized. In this manner one of these lateral heel dimensions 42 will be utilized as the chosen width and no additional adjustments or variations need be made since the narrower heel will just fit further or deeper into the heel receiving means 54. No variations are necessary for the frontal member 16 since the rigid upper member 24 will provide a frontal shoe area receiving opening which is capable of receiving any size of shoe.

In operation the worker will be able to attach the stilts to his shoes almost instantly merely be the pointing downward of his toe and the sliding of the toe area of the foot into the opening adapted for receiving the front end of the shoe defined by the upper surface of the frontal base and the lower surface of the rigid upper member 24. Then the worker should push downwardly with his heel such that the heel of the shoe will become lodged in the heel receiving means 54.

In this manner the heel of the shoe 40 will seat in the heel receiving means 54 and will lock the stilt to the shoe of the user. In alternative configurations further lateral movement of the toe area of the shoe will be prevented by the utilization of lateral frontal plates 34 and further gripping of the heel area of the shoe 40 will be facilitated by providing the lateral heel plates 20 with a slight inward inclination. Although not necessary to performance of the present invention the inclined lateral heel plates 40 will provide slightly inwardly lateral heel retaining surfaces 40 which will tend to fit in above the rear portion of the shoe and the heel thereof to prevent upward movement and thereby more fixedly secure the shoe to the stilt.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit scope of the invention.

I claim:

1. Adapters for mating the shoe receiving stilt platform of a utility stilt with the shoe of the user, the adapters including a frontal member adapted to receive and hold the frontal area of a user's shoe therein and a heel member adapted to receive and hold the heel area of the user's shoe therein when the frontal area of the user's shoe is placed within the frontal member, the frontal member including a frontal base having means extending from one lateral end of the frontal base to the other lateral end thereof and disposed in spaced relation above said base member to define a frontal shoe receiving opening into which the user will place the frontal area of the shoe, and a heel member including a heel base and at least two lateral heel plates extending upwardly from the lateral edges of said heel base and being angled with respect to one another in the vertical direction with the front ends thereof spaced from one another a greater distance than the rear ends and adapted to receive and hold the heel area of the user's shoe therein; the frontal member having means for adjustably mounting said frontal member longitudinally of a stilt platform and said heel member having means for adjustably mounting said heel member longitudinally of said stilt platform wherein the spacing between said frontal member and said heel member may be adjusted, whereby on such adjustment together with the means extending in spaced relation above and between said one end of said frontal base to the other said end, said adapters may be fixedly adjusted onto a shoe receiving platform whereby any size shoe to which said adapters have been properly adjusted can be stepped into said adapters and held to the stilt platform and released therefrom only on sufficient upward and rearward pressure being exerted to said shoe to free it from said adjusted adapters.

2. The adapters as in claim 1 wherein said means extending from one lateral end thereof comprises an upper member extending from one end to said other end.

3. The adapters as in claim 2 wherein said upper member is rigid.

4. The adapters as in claim 1 wherein said means extending from one lateral end of said frontal base to said other lateral end thereof includes a lateral front plate at each opposite lateral end of the frontal base which extends upwardly therefrom to facilitate retaining of the shoe of the user within the frontal shoe area by preventing lateral movement or sliding of the shoe therein with an upper member extending from one lateral plate to the other.

5. The adapters as in claim 4 wherein said upper member is rigid.

6. The adapters as in claim 4 wherein said upper member is adjustable.

7. The adapters as in claim 1 wherein said means for adjustably mounting said frontal member and said heel member longitudinally of said stilt platform comprises longitudinally spaced holes located on each side of the centerline of each of said frontal and heel members and extending vertically therethrough to be fastened to said stilt platform by bolts and nuts through the selected holes for the longitudinal adjustment therebetween.

* * * * *